US007733195B2

(12) United States Patent
Conway et al.

(10) Patent No.: US 7,733,195 B2
(45) Date of Patent: Jun. 8, 2010

(54) WAVEGUIDE ATTENUATOR HAVING COAXIAL PROBES

(75) Inventors: Jay William J. Conway, Ipswich, MA (US); Robert McCowan, Newbury, MA (US); George Solomon, Columbia, PA (US)

(73) Assignee: Communications & Power Industries, Inc., Beverly, MA (US)

( * ) Notice: Subject to any disclaimer, the term of this patent is extended or adjusted under 35 U.S.C. 154(b) by 261 days.

(21) Appl. No.: 12/047,399

(22) Filed: Mar. 13, 2008

(65) Prior Publication Data

US 2008/0224802 A1 Sep. 18, 2008

Related U.S. Application Data

(60) Provisional application No. 60/894,989, filed on Mar. 15, 2007.

(51) Int. Cl.
*H01P 1/22* (2006.01)

(52) U.S. Cl. ..... 333/81 B

(58) Field of Classification Search ..... 333/81 B, 333/81 R, 208, 209, 239, 248, 157; 327/308, 327/309

See application file for complete search history.

(56) References Cited

U.S. PATENT DOCUMENTS 4,772,893 A * 9/1988 Iwasaki ..... 343/779
5,309,048 A 5/1994 Khabbaz
5,440,280 A 8/1995 Lord
6,489,856 B1 12/2002 Weigand

OTHER PUBLICATIONS

Application Notes for Variable Attenuators, http://americanmicrowavecorp.com/amc/sform/appnotes2/ 2003.

Setty, "Digital Step Attenuators Offer Precision and Linearity," Microwave/Millimeter-Wave Technology (www.rfdesign.com) p. 34 (Aug. 2005).

Wade, "Rectangular Waveguide to Coax Transition Design," QEX (w1ghz@arrl.net) p. 10 (Nov./Dec. 2006).

* cited by examiner

*Primary Examiner*—Stephen E Jones
(74) *Attorney, Agent, or Firm*—Nutter McClennen & Fish LLP

(57) ABSTRACT

Various methods and devices are provided for attenuating RF signals propagating within a waveguide. In particular, a plurality of coaxial probes are incorporated into the waveguide for the purpose of attenuating X-band RF signals. In one embodiment, a 7-bit, 3 dB linear digital attenuator is provided having a waveguide in a racetrack configuration. Coaxial probes in communication with the waveguide are adapted to couple energy to and from a signal traveling within the waveguide. The attenuator can also include switches adapted to reflect coupled energy back into the waveguide or pass the coupled energy to a resistive termination.

25 Claims, 7 Drawing Sheets

WAVEGUIDE ATTENUATOR HAVING COAXIAL PROBES

RELATED APPLICATIONS

This application claims priority to U.S. Provisional Patent Application No. 60/894,989, filed Mar. 15, 2007, entitled "Waveguide Attenuator Having Coaxial Probes," which application is incorporated by reference herein.

FIELD OF THE INVENTION

The present invention generally relates to methods and devices for attenuating radio frequency (RF) signals propagating within a waveguide. In particular, a plurality of coaxial probes are incorporated into the waveguide for the purpose of attenuating the RF signal.

BACKGROUND OF THE INVENTION

An attenuator is a device used to reduce the power level of a signal without introducing any appreciable distortion. In particular, attenuators provide amplitude control for high frequencies such as microwaves. In many microwave systems, microwave radio frequency (RF) attenuators are required for automatic gain control of both receiver and transmitter systems. Microwave RF attenuators are available in many formats including fixed-value attenuators, continuously variable attenuators, and digital attenuators.

Digital attenuators have a distinguishing feature in that a known amount of attenuation can be selected at high speed according to the state of a logic signal. Digital attenuators vary the strength of input signals in response to digital control signals and can switch in discrete, finite attenuation states. For example, in a typical 1-bit digital attenuator, the amount of attenuation, or the "attenuation step," offered by the attenuator varies depending on whether the bit of the control signal has a value of "0" or "1." Typically, if a 2-bit or other multiple bit digital attenuator is desired, a plurality of 1-bit digital attenuators are cascaded to produce the desired m-bit digital attenuator (where m>2).

In order to achieve increased attenuation accuracy while maintaining a fixed attenuation amount, smaller and more accurate attenuation steps are required for greater resolution. This requires multiple bits that are sensitive to fine adjustment and relatively insensitive to temperature and incident power. As the number of bits increase, however, distortion and insertion loss also increase, which is disadvantageous in many systems. Accordingly, it is an object of this invention to satisfy the need for improved multi-bit digital attenuators having fine resolution and accurate attenuation capabilities with minimal distortion and insertion loss.

SUMMARY OF THE INVENTION

The present invention generally provides for a digital attenuator having a waveguide for receiving a signal to be attenuated and for outputting the attenuated signal. The attenuator can include at least one bit having at least one coaxial probe in communication with the waveguide to couple energy to and from the signal traveling within the waveguide. In an embodiment, the attenuator can include at least one coaxial line in communication with the coaxial probe that is effective to receive the energy coupled from the signal. A switch can also be included that reflects the coupled energy back into the waveguide or passes the coupled energy to a resistive termination. In one embodiment, the waveguide can have a racetrack configuration.

In another embodiment, the digital attenuator can include a plurality of bits, for example, seven bits. The seven bits can include, for example, a 1.6 dB bit, a 0.8 dB bit, a 0.4 dB bit, a 0.2 dB bit, a 0.1 dB bit, a 0.05 dB bit, and a 0.025 dB bit. At least one of the bits can include two coaxial probes effective to couple equal amounts of energy to and from the signal traveling within the waveguide, where the signal is in the X-band of the electromagnetic spectrum with a maximum band of about 40 MHz.

In one embodiment, the maximum attenuation of the signal is about 3 dB with an attenuation error that is less than ±0.03 dB over an entire attenuation range of about 0 to 3 dB. The attenuation is insensitive to incident power levels up to and including about 1000 watts and insensitive to temperature in the range of about −40 degrees Celsius to about 75 degrees Celsius. The switch in the digital attenuator can be a PIN diode and the attenuator can be configured to switch in about 400 ns. Optionally, the bit in the attenuator can be configured to be driven by an analog to digital driver. In an embodiment, insertion losses are below about 3 dB. The waveguide can also include first and second coaxial connectors having first and second coaxial probes configured to introduce a signal into and out of the waveguide. In one embodiment, the attenuator can further include ferrite circulators or isolators configured to isolate an input and an output signal.

The present invention also provides methods for attenuating an RF signal that include inputting an RF signal into an attenuator having a waveguide, and sending a digital command to at least one bit to toggle a switch. The method also includes attenuating the RF signal by an amount corresponding to the bit and outputting the RF signal attenuated by an amount corresponding to the bit plus or minus about 0.03 dB. Alternatively, the method can include sending digital command signals to a plurality of bits, for example, seven bits that can include eleven coaxial probes, each having a switch that opens or closes in response to the digital command signals.

In an embodiment, the method can further include attenuating the RF signal by about 3 dB and switching in less than 400 ns. The attenuator can include at least one coaxial probe for coupling energy out of the RF signal for attenuation.

BRIEF DESCRIPTION OF THE DRAWINGS

The invention will be more fully understood from the following detailed description taken in conjunction with the accompanying drawings, in which.

DETAILED DESCRIPTION OF THE INVENTION

Certain embodiments will now be described to provide an overall understanding of the principles of the structure, function, manufacture, and use of the devices and methods disclosed herein. One or more examples of these embodiments are illustrated in the accompanying drawings. Those skilled in the art will understand that the devices and methods specifically described herein and illustrated in the accompanying drawings are non-limiting embodiments and that the scope of the present invention is defined solely by the claims. The features illustrated or described in connection with one embodiment may be combined with the features of other embodiments. Such modifications and variations are intended to be included within the scope of the present invention.

The present invention provides methods and devices useful for attenuating radio frequency (RF) signals propagating within a waveguide. In particular, a multi-bit linear digital attenuator is provided for attenuating X-band RF signals using coaxial probes. In one embodiment shown in FIGS. 1A, 1B and 2, a 7-bit, 3 dB digital attenuator is illustrated having a dielectrically loaded waveguide 10. A person skilled in the art will appreciate, however, that any number of bits can be used as necessary, and any attenuation can be achieved depending on the number and configuration of bits chosen.

Figure 1A:
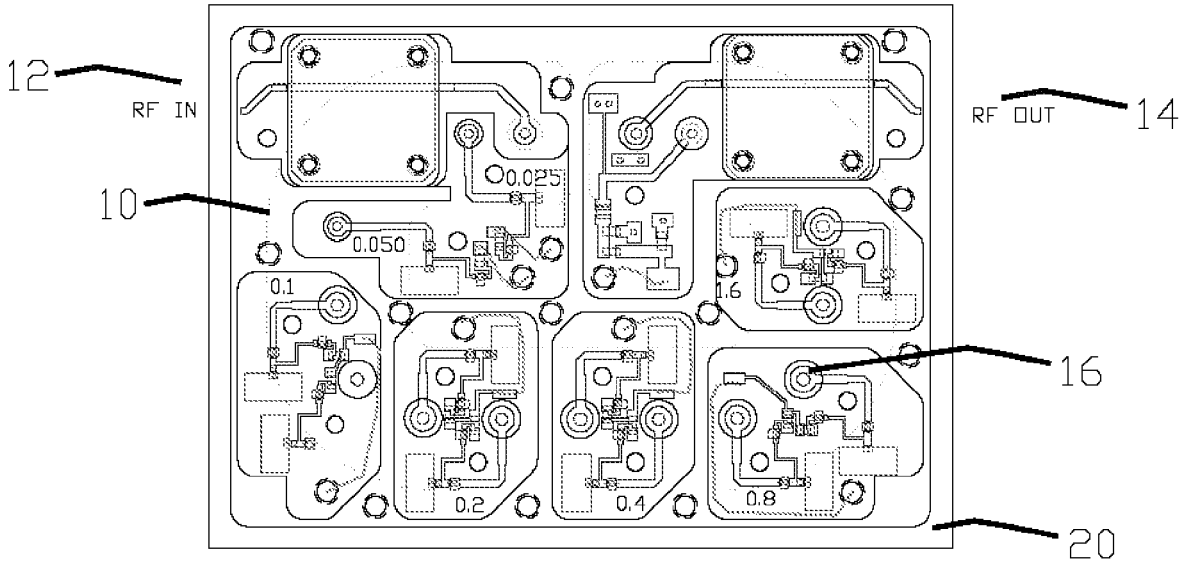
FIG. 1A illustrates an embodiment of a 7-bit digital attenuator having a waveguide in a racetrack configuration.
Figure 1B:
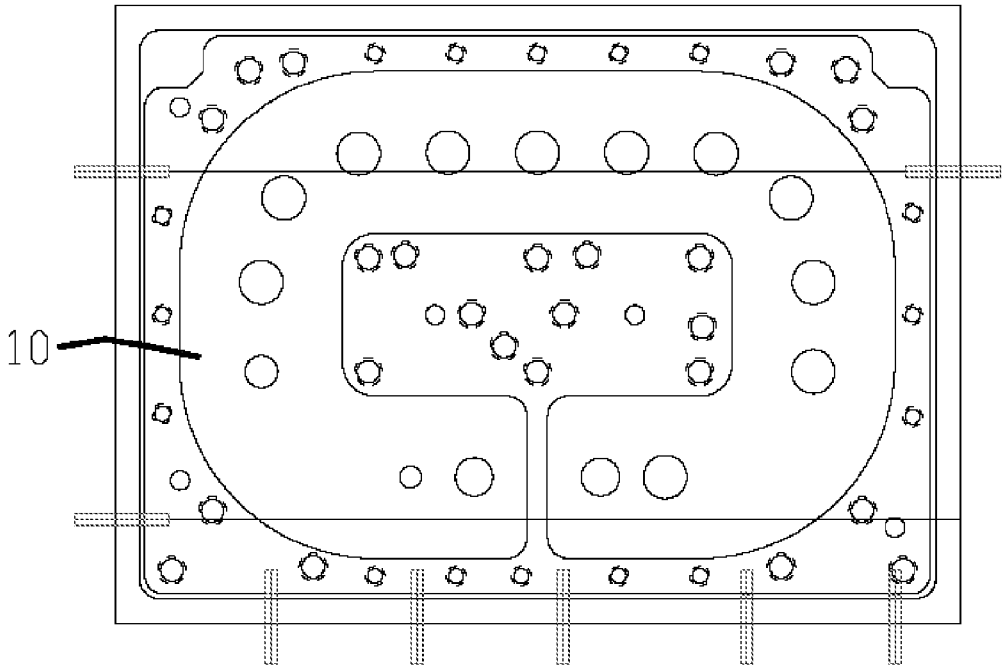
FIG. 1B illustrates an embodiment of the racetrack configuration of the attenuator of FIG. 1.

More specifically, FIG. 1A illustrates the RF side of an exemplary waveguide 10 that includes micro strip ports 12, 14 at the ends of the waveguide racetrack which are used to couple an RF signal in and out of the attenuator. An X-band pulse from a magnetron modulator can serve as the RF signal and can enter the micro strip port 12 through a drop-in isolator that is coupled into the waveguide using a coaxial transition. In one embodiment, the waveguide 10 can further include ferrite circulators or isolators configured to isolate an input and an output signal. A person skilled in the art will appreciate that any mechanism known in the art can be used to couple the RF signal in and out of the waveguide, including coaxial connectors and probes. Further, the X-band source is not limited to a magnetron modulator and instead can originate with any RF source, whether high or low power. FIG. 1B illustrates the racetrack configuration of the waveguide 10.

Figure 2:
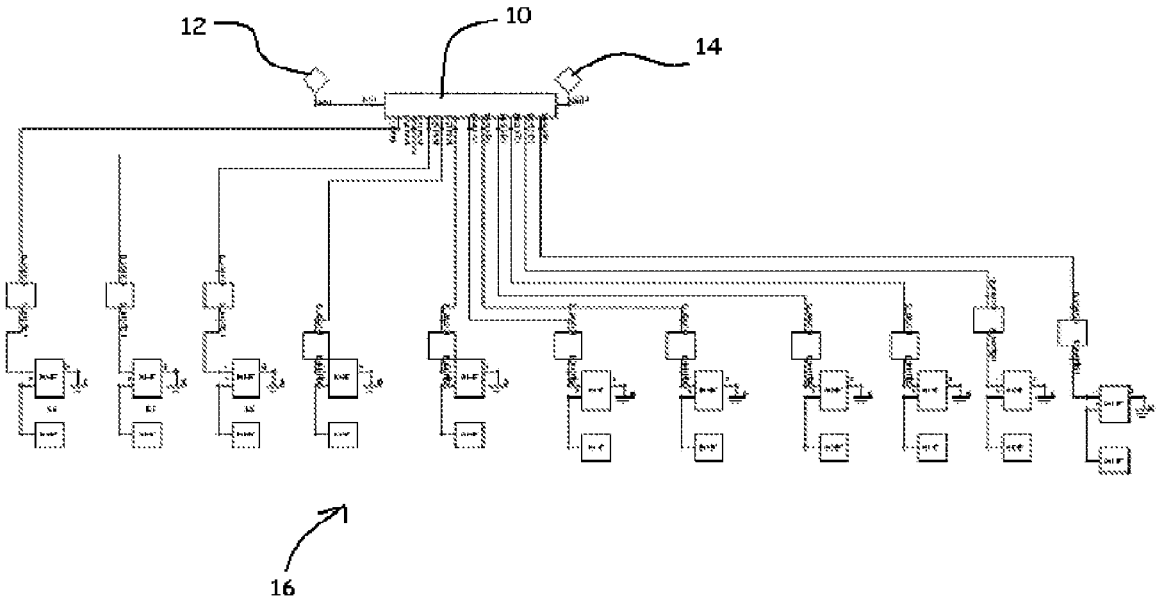
FIG. 2 illustrates a coaxial probe and switch configuration of the attenuator of FIG. 1.

A series of coaxial probes 16, as shown in FIG. 2, are coupled to the waveguide 10 at various positions along the racetrack configuration. These probes 16 are effective to couple energy from the waveguide 10 into coaxial lines to be reflected or terminated as required and as will be described in detail below. A control signal from a driver board enters each cavity through a coaxial feed through and indicates the switching commands for the probes 16. A final cavity at the output of the waveguide 10 contains a power detector, a coaxial transition out of the waveguide 10 and an output isolator for transmitting the attenuated RF signal through the micro strip port 14.

Figure 3A:
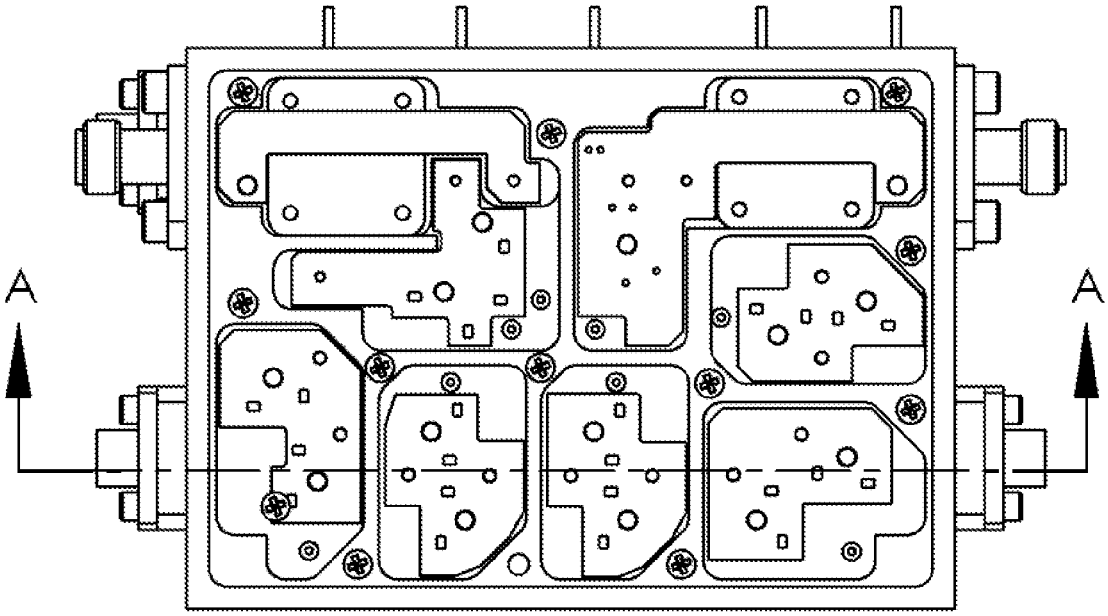
FIG. 3A illustrates a top view of the attenuator of FIG. 1.
Figure 3B:
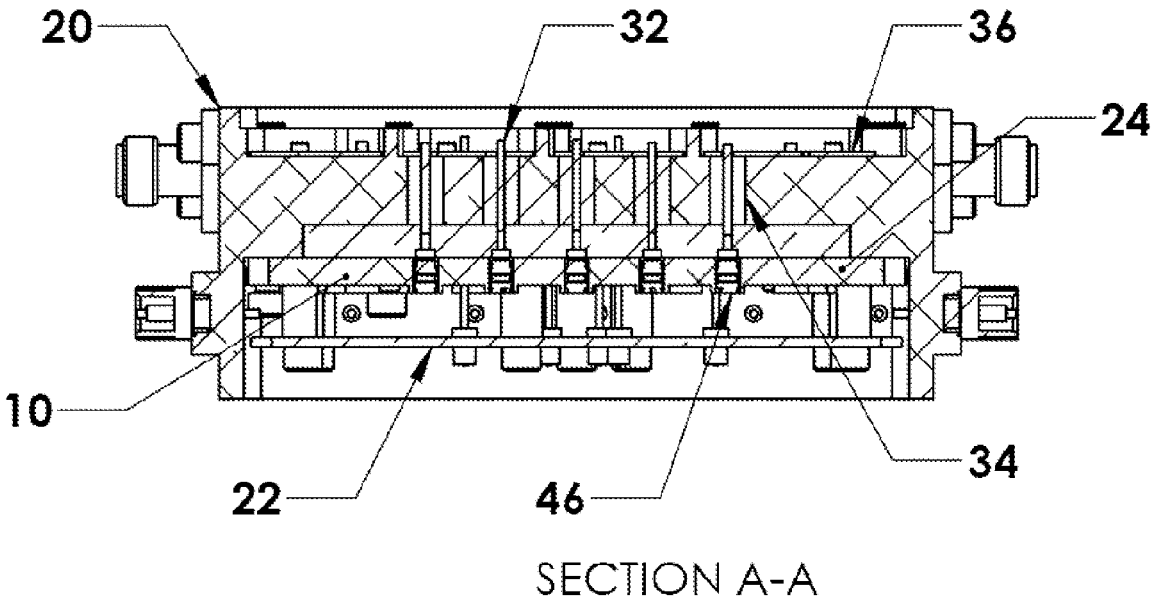
FIG. 3B illustrates a cross section of the attenuator of FIG. 1.

Structurally, as shown in FIGS. 3A and 3B, the waveguide 10 can be embedded into the center web of a chassis or housing 20, and a housing cover 24 can be bolted over the racetrack to form a top of the waveguide 10. In the illustrated embodiment, the cover 24 can include fine adjustment tuning screws 46 effective to tune the performance of the attenuator. A driver PC board 22 can be mounted in the housing 20 and coupled to DC connections and any control connections as needed. A person skilled in the art will appreciate that the driver board 22 and control connections can be mounted anywhere on or around the waveguide housing 20 as needed. All transitions from coax to waveguide can include hermetic transitions, and in one embodiment, the entire assembly including isolators, couplers, switches, and loads can be enclosed in a hermetic housing. FIGS. 3A and 3B also illustrate exemplary positions of coaxial probes 32 and coaxial lines 34, as will be described in more detail below.

In an embodiment, a WR90 waveguide having a racetrack configuration can be used in the construction of the attenuator. This particular choice of waveguide has a cross section of 0.5 inches by 0.12 inches. A person skilled in the art will appreciate that WR62, WR75, and WR112 waveguides can also be used as needed, as well as any other suitable configuration. The dielectric used in the waveguide can be a high-grade, temperature-stable dielectric with a dielectric constant of, for example, 2.9. Other dielectrics can be chosen as needed for a particular sized waveguide. Alternatively, the waveguide need not be dielectrically loaded.

The coaxial probes coupled to the waveguide can be subminiature A (SMA) connectors as well as any other suitable connector known in the art. The coaxial probes can be integrally formed with the coaxial lines, and because the probes are extensions of the center conductor of the coaxial lines, there will be no transition or losses associated with a transition. The coaxial lines can be Teflon-loaded and can transition into microstrip or another planar transmission line known in the art.

Figure 4:
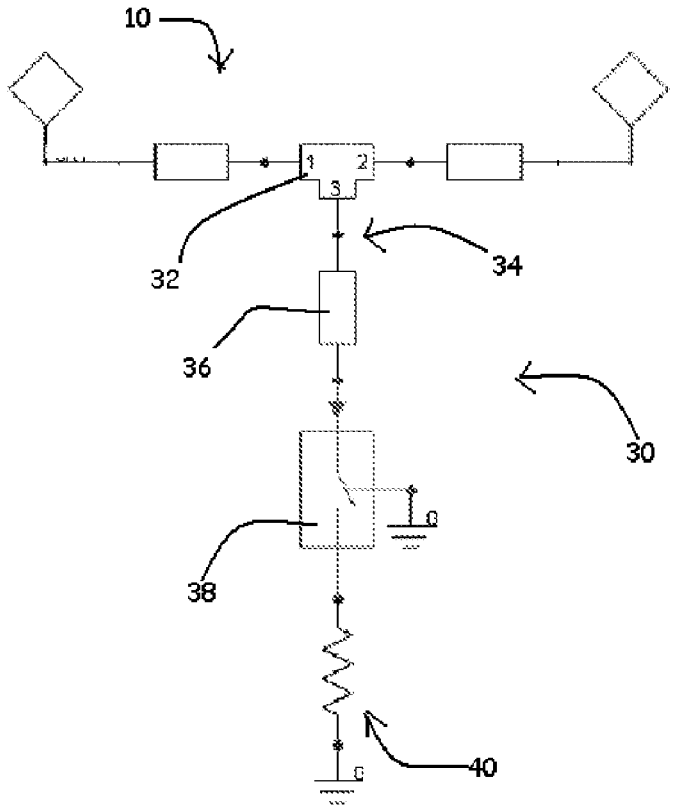
FIG. 4 is a schematic illustrating individual bits of the attenuator of FIG. 1.

FIG. 4 shows one embodiment of an exemplary bit 30 having a coaxial probe 32 in communication with the waveguide 10 and adapted to couple energy to and from the waveguide 10. The coaxial probe 32 transitions to a coaxial line 34, which then transitions into a microstrip line 36. A switch 38 can be included in the line effective to toggle the bit 30 between a terminated state and reflective state, thereby either reflecting the coupled energy back into the waveguide 10 or passing it on to a resistive termination 40. The switch 38 can be, for example, a 300V PIN switch diode having a junction capacitance of approximately 15 pF. Other switches known in the art as well as diodes with smaller junction capacitances can also be used, depending on performance requirements. When the switch 38 is toggled to the terminated state, the coupled energy can be transmitted to the resistive termination 40, thereby providing the required attenuation to the signal. When the switch 38 is toggled to the reflective state, the energy coupled from the waveguide 10 is reflected back into the waveguide 10 and rejoins the propagating RF signal.

Figure 5:
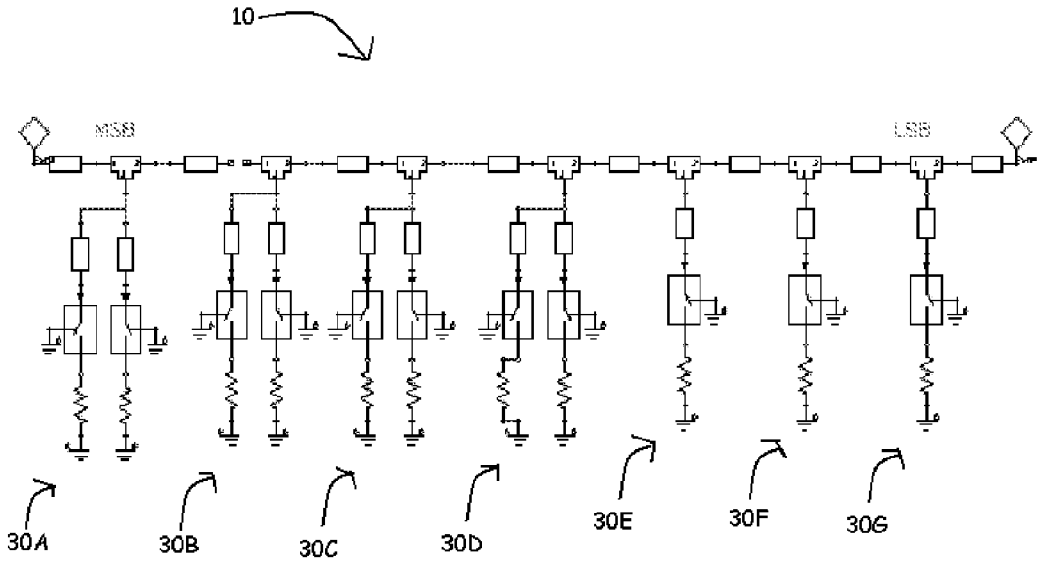
FIG. 5 is a schematic illustrating a single-probe bit of the attenuator of FIG. 1.

As noted above and as will be appreciated by those skilled in the art, any number of bits can be coupled to the waveguide depending on specific performance requirements. For example, a single bit coupled to a first waveguide can be used alone, or the first waveguide can be coupled to a second waveguide having one or more bits. In the latter case, two or more waveguides each having one or more bits can be used in combination as needed. The advantages of the invention, however, are more readily apparent in embodiments in which a plurality of bits are used with a single waveguide. In one embodiment shown in FIG. 5, seven bits are coupled to the waveguide 10 and can include a 1.6 dB bit 30A, a 0.8 dB bit 30B, a 0.4 dB bit 30C, a 0.2 dB bit 30D, a 0.1 dB bit 30E, a 0.05 dB bit 30F, and a 0.025 dB bit 30G.

In order that the attenuator behave well over the entire attenuation range, it is important that the individual bits not interact. For example, the value of the 0.1 dB bit 30E should not change when another bit is toggled. This requirement is satisfied when the individual bits are well-matched and separated by sufficient waveguide 10 within walled cavities to eliminate high-order-mode coupling. For bits with a value less than 0.1 dB, a single probe matches well enough to meet this requirement. For larger bits, a pair of probes spaced by ¼ wavelength can be used; the ¼ wavelength spacing minimizes the reflection from a pair of probes. For example, the most significant bit (MSB) can be achieved using two 0.8 dB probes. This has a further advantage of splitting the power so that the maximum power at any one switch/load combination can be maintained at a lower level as needed. Further, arranging the probes in this manner allows for finer control over attenuation accuracy and provides greater resolution.

Figure 6:
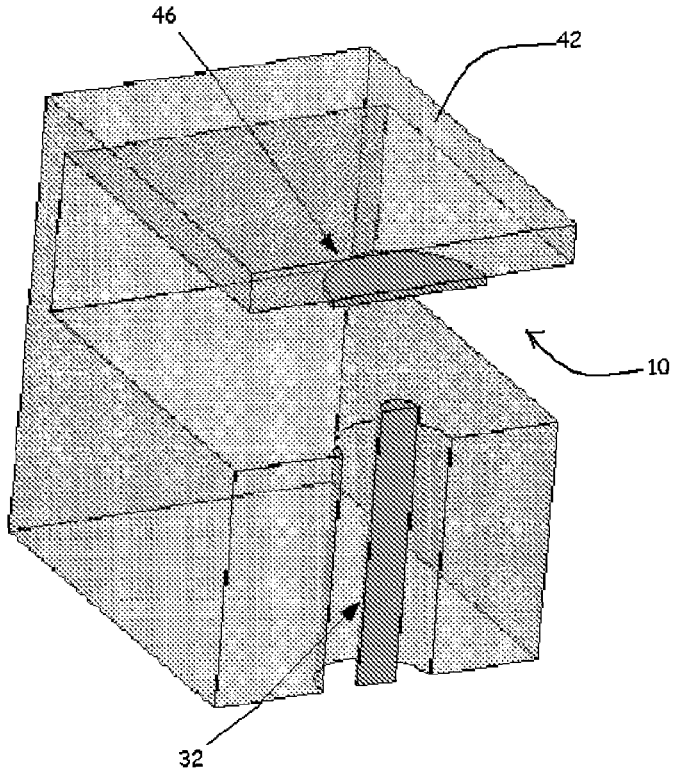
FIG. 6 is a perspective view of the geometry of an exemplary single bit of the attenuator of FIG. 1 having one coaxial probe.
Figure 7:
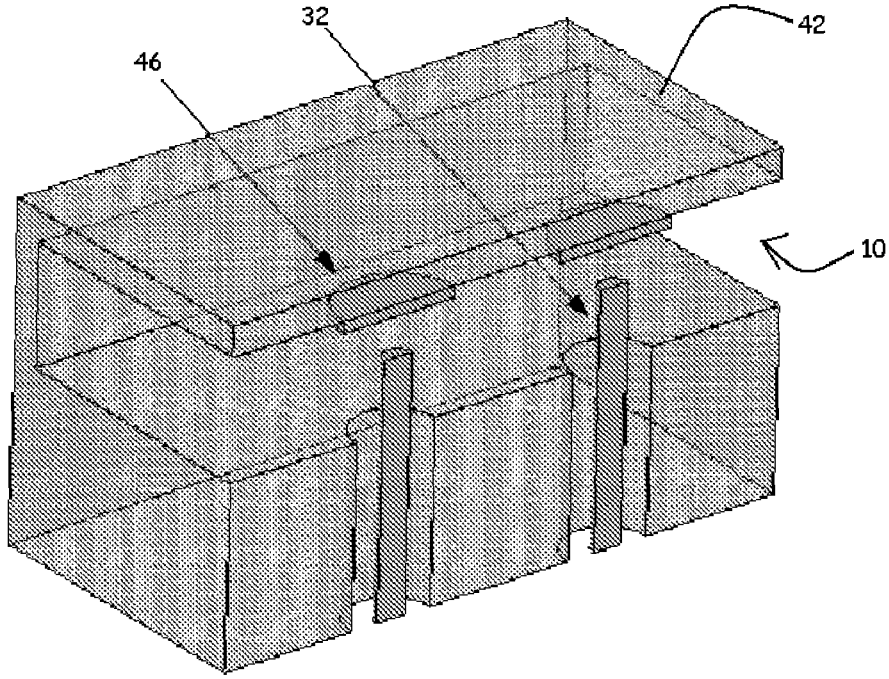
FIG. 7 is a perspective view of the geometry of an exemplary single bit of the attenuator of FIG. 1 having two coaxial probes.

FIGS. 6 and 7 show exemplary geometries of a coaxial probe coupled into the waveguide 10 as described above. Energy is coupled into a coaxial line through a coaxial probe 32 that extends into the waveguide 10. The attenuation value of a one-probe bit can be determined by the length of the coaxial probe 32 extending into the waveguide 10. For example, in order to attenuate a signal traveling in the waveguide by 0.05 dB, the coaxial probe 32 will extend into the waveguide a distance D1. In order to attenuate the signal by 0.8 dB, the coaxial probe will extend further into the waveguide a distance D2, where D1<D2. A first order determination of the correct probe length corresponding to a required attenuation amount can be made, and the coaxial probe 32 can be coupled to the waveguide so that the probe extends into the waveguide with this particular length. A disk 46 on a top wall 42 of the waveguide 10 can represent a tuning diaphragm or screw that can be used to trim the coupling value of the probe 32 to achieve higher order accuracy for a specific attenuation. Thus, the disk 46 can be used to make fine adjustments to the effective length of the coaxial probe extending into the waveguide to ensure that each bit value is accurate. The disk 46 can also be used to adjust bit value under different operating conditions as needed.

In FIG. 6, the basic geometry of a one-probe coupler is shown in cross-sectional view. As noted above, the coupling of the probe 32 is set by the length of probe conductor that protrudes into the waveguide. This 0.1 dB bit probe couples approximately 2.5% of the power in the waveguide out into the coaxial line. When this power is absorbed by a load on the coaxial line, the waveguide power is attenuated by 0.1 dB. FIG. 7 illustrates the geometry for a two-probe coupler having a 1.6 dB bit. Here, each probe 32 can couple out half of the power required to achieve the 1.6 dB attenuation. The coupled signals are 90 degrees out of phase so that reflection mismatches from the individual probes cancel.

In one exemplary method, a signal having a frequency in the X-band is introduced into the waveguide. The signal can originate with any waveform generator known in the art and in one embodiment, the signal is generated by a high powered magnetron. As the signal travels within the waveguide racetrack, a digital signal is sent to at least one bit indicating to the bit whether a switch associated with the bit should be terminated or reflective. In the reflective configuration, any energy coupled through a coaxial probe associated with the bit will be reflected back into the waveguide to rejoin the signal traveling within the waveguide. In the terminated configuration, the energy coupled by the coaxial probe will travel to a resistive termination, thereby attenuating the signal traveling within the waveguide. In an embodiment having seven bits coupled to the waveguide, digital signals are sent to all seven bits to communicate the attenuation required at a particular time. Tuning diaphragms associated with each coaxial probe can be adjusted as needed to ensure that each bit is coupling out the correct amount of energy to be attenuated.

In an embodiment in which all bits are toggled on, the exemplary 7-bit digital attenuator described above can attenuate a pulsed X-band signal having a maximum band of 40 MHz by 3 dB with an attenuation error of less than ±0.03 dB, which is significantly better than the prior art. The attenuator is essentially insensitive to incident power levels and temperature and maintains a switching speed of about 400 ns, all of which will be described in detail below.

Performance

Figure 8:
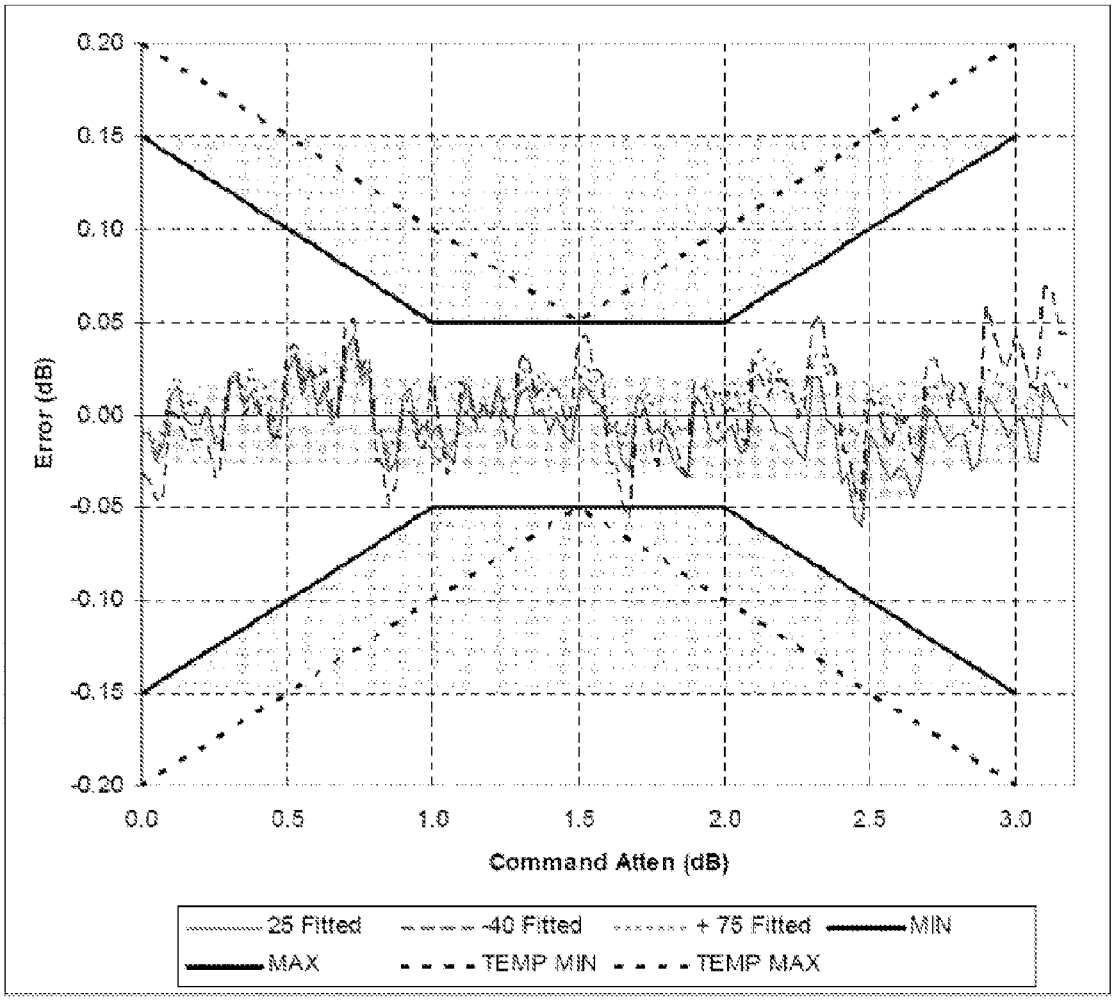
FIG. 8 illustrates the attenuation performance of the attenuator of FIG. 1 at low power.

The performance of the above described 7-bit, 3 dB digital attenuator was tested at low power levels to determine whether adjustments would need to be made to the bits to compensate for temperature variation. Digital data was driving each bit and a switch box supplying DC voltage and current to each bit of the switch was used. FIG. 8 illustrates a plot of the command attenuation versus error in the actual attenuation achieved for different temperatures. The solid line represents 25 degrees Celsius, the short dashed line represents 75 degrees Celsius, and the long dashed line represents −40 degrees Celsius. As shown, the bits are essentially insensitive to temperature and do not have to be adjusted to compensate for temperature change within this range.

Figure 9:
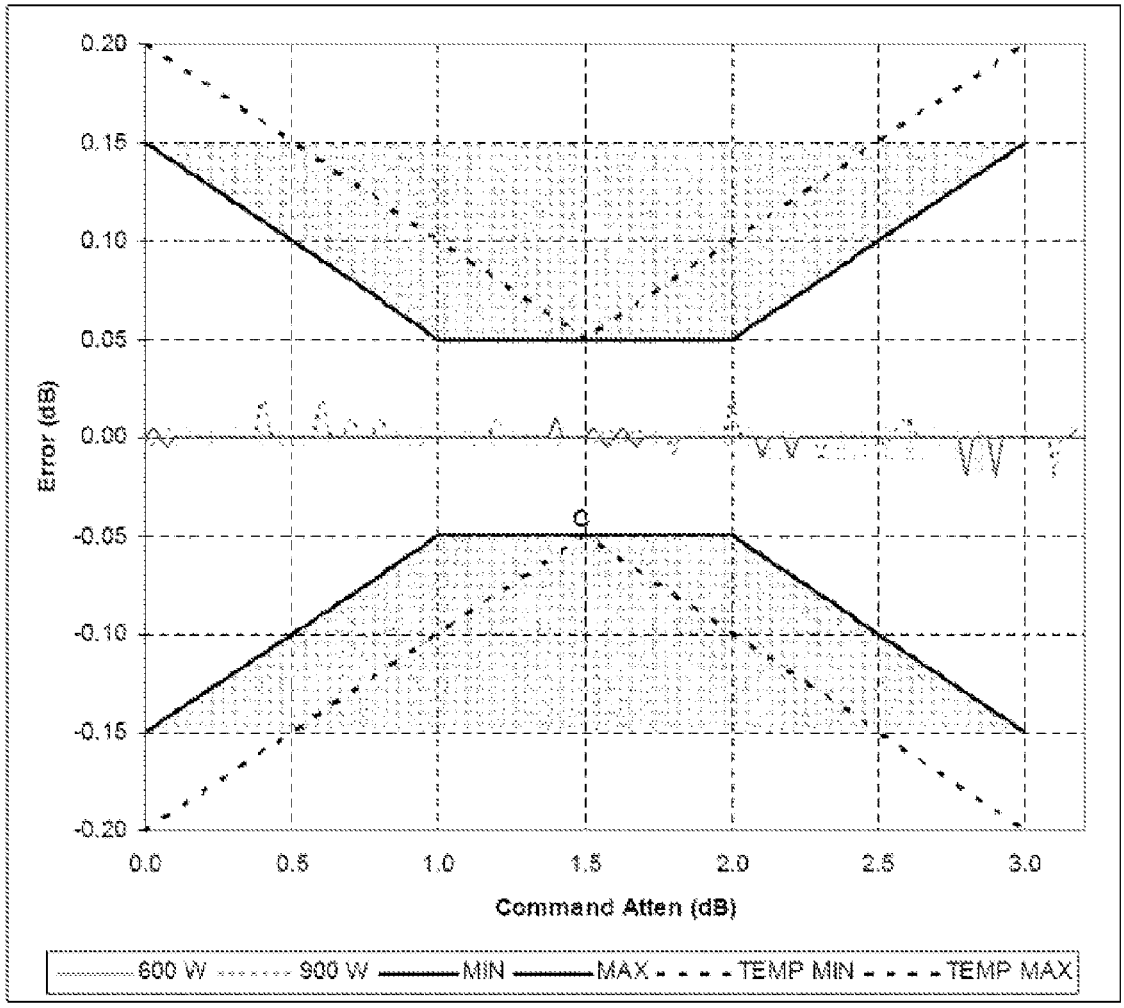
FIG. 9 illustrates the attenuation performance of the attenuator of FIG. 1 at high power.

The attenuator was then tested for accuracy with a high power magnetron and an adjustable modulator to change the pulsed power from the magnetron. The magnetron was calibrated to at 600, 700, 800, 900, and 1000 watts of peak power. The attenuator performance was measured with two series calibrated vane attenuators and a crystal detector to measure the attenuation. Digital data was driving each bit with a switch box supplying DC voltage and current to each bit. Data was taken in 0.1 dB steps with selected data of the 0.05 dB and the 0.025 dB steps to reduce the number of data points and time required. As shown in FIG. 9, the data shows very little variation as a function of power and no signs of compression on the diodes. Specifically, FIG. 9 illustrates data taken at 600 and 900 watts of input power and indicates that the bits are extremely insensitive to incident power. Additional data was taken on the 1.6 dB and 0.8 dB bits and both were found to be insensitive to power levels up to 1000 watts. Further, these tests indicate that the attenuation achievable is extremely accurate, with a bounded range of less than ±0.03 dB, which is significantly better than the prior art.

An analog to digital converter was also tested to drive each bit of the switch. The temperature data obtained indicates similar bit performance to that described above. With the ADC installed, the switching speed was measured. The driver set the diodes to the reverse bias condition during the interpulse period. After sampling the spin error input, the driver supplied the correct current or reverse voltage to the individual bits. The switching speed was then measured from the rising edge of the first pulse clock pulse until the detected RF was stable. The attenuator was measured to switch in 400 ns while maintaining an error of ±0.03 dB.

Finally, the insertion loss of the attenuator was measured as a function of temperature and was found to be well below 3 dB. For example, at −40 degrees Celsius, the insertion loss was measured to be 2.59 dB. At 25 degrees Celsius, the insertion loss was measured to be 2.87 dB, and at 75 degrees Celsius, the insertion loss was measured to be 2.69 dB.

As described above, an X-band, 7-bit, 3 dB digital attenuator has been demonstrated that is capable of extremely accurate attenuation through the use of coaxial probes. Attenuation accuracy is bounded by less than ±0.03 dB over the entire attenuation range, which is a significant improvement over the prior art that can be attributed, in part, to the use of coaxial probe coupling. Further, the use of PIN switch diodes contributes to the attenuator being essentially insensitive to temperature and incident power when compared with existing devices in which attenuation tends to vary as the incident power fluctuates. In addition, the attenuator has extremely fast switching speeds. One skilled in the art will appreciate further features and advantages based on the above-described embodiments. Accordingly, the application is not to be limited by what has been particularly shown and described, except as indicated by the appended claims. All publications and references cited herein are expressly incorporated herein by reference in their entirety.

What is claimed is:

1. A digital attenuator, comprising:

a waveguide, the waveguide receiving a signal to be attenuated, and outputting the attenuated signal;

at least one bit comprising at least one coaxial probe in communication with the waveguide to couple energy to and from a signal traveling within the waveguide;

at least one coaxial line in communication with the at least one coaxial probe effective to receive the energy coupled from a signal by the at least one coaxial probe and including a switch, wherein the switch reflects the coupled energy back into the waveguide or passes the coupled energy to a resistive termination.

2. The attenuator of claim 1, further comprising a plurality of bits.

3. The attenuator of claim 1, further comprising seven bits.

4. The attenuator of claim 3, wherein the seven bits include a 1.6 dB bit, a 0.8 dB bit, a 0.4 dB bit, a 0.2 dB bit, a 0.1 dB bit, a 0.05 dB bit, and a 0.025 dB bit.

5. The attenuator of claim 1, wherein the at least one bit comprises two coaxial probes effective to couple equal amounts of energy to and from a signal traveling within the waveguide.

6. The attenuator of claim 1, wherein attenuation error is less than ±0.03 dB over an entire attenuation range of about 0 to 3 dB.

7. The attenuator of claim 1, wherein the maximum attenuation of a signal is about 3 dB.

8. The attenuator of claim 1, wherein the waveguide includes first and second coaxial connectors having first and second coaxial probes configured to introduce a signal into and out of the waveguide.

9. The attenuator of claim 1, further comprising ferrite circulators or isolators configured to isolate an input and an output signal.

10. The attenuator of claim 1, wherein the signal is in the X-band of the electromagnetic spectrum and has a maximum band-width of about 40 MHz.

11. The attenuator of claim 1, wherein the attenuation is insensitive to incident power levels up to and including about 1000 watts.

12. The attenuator of claim 1, wherein the attenuation is insensitive to temperature in the range of about −40 degrees Celsius to about 75 degrees Celsius.

13. The attenuator of claim 1, wherein the attenuator is configured to switch in about 400 ns.

14. The attenuator of claim 1, wherein the switch is a PIN diode.

15. The attenuator of claim 1, wherein the at least one bit is configured to be driven by an analog to digital driver.

16. The attenuator of claim 1, wherein the waveguide is in a racetrack configuration.

17. The attenuator of claim 1, wherein insertion losses are below about 3 dB.

18. A method of attenuating an RF signal, comprising:

inputting an RF signal into an attenuator having a waveguide;

sending a digital command to at least one bit to toggle a switch;

attenuating the RF signal by an amount corresponding to the at least one bit;

outputting the RF signal attenuated by an amount corresponding to the at least one bit plus or minus about 0.03 dB.

19. The method of claim 18, further comprising attenuating the RF signal by about 3 dB.

20. The method of claim 18, wherein the attenuator includes at least one coaxial probe for coupling energy out of the RF signal for attenuation.

21. The method of claim 18, further comprising sending digital command signals to a plurality of bits.

22. The method of claim 18, further comprising sending digital command signals to seven bits.

23. The method of claim 22, wherein the seven bits include eleven coaxial probes each having a switch that opens or closes in response to the digital command signals.

24. The method of claim 18, wherein the attenuator switches in about 400 ns.

25. The method of claim 18, wherein the at least one bit is insensitive to incident power up to about 1000 watts and temperature between about −40 degrees Celsius and about 75 degrees Celsius.

* * * * *

UNITED STATES PATENT AND TRADEMARK OFFICE

CERTIFICATE OF CORRECTION

PATENT NO. : 7,733,195 B2
APPLICATION NO. : 12/047399
DATED : June 8, 2010
INVENTOR(S) : William J. Conway et al.

It is certified that error appears in the above-identified patent and that said Letters Patent is hereby corrected as shown below:

Title Page In the Inventors:

Left hand column Item (75), change:

"Jay William J. Conway, Ipswich, MA"

to

William J. Conway, Ipswich, MA

Signed and Sealed this

Fifth Day of October, 2010

David J. Kappos

David J. Kappos
*Director of the United States Patent and Trademark Office*